US012035854B2

(12) United States Patent
Tran

(10) Patent No.: US 12,035,854 B2
(45) Date of Patent: Jul. 16, 2024

(54) SOAP CONTAINER FOR DRYING A SOAP INSIDE A CLOSED CONTAINER

(71) Applicant: Phuc-An Tran, Amberg (DE)

(72) Inventor: Phuc-An Tran, Amberg (DE)

(73) Assignee: Tran & Tran Holding GmbH, Amberg (DE)

( * ) Notice: Subject to any disclaimer, the term of this patent is extended or adjusted under 35 U.S.C. 154(b) by 327 days.

(21) Appl. No.: 17/551,814

(22) Filed: Dec. 15, 2021

(65) Prior Publication Data

US 2022/0202261 A1 Jun. 30, 2022

(30) Foreign Application Priority Data

Dec. 30, 2020 (DE) ..... DE202020107614.0
Dec. 14, 2021 (EP) ..... 21214342

(51) Int. Cl.
*B65D 85/00* (2006.01)
*A47K 5/05* (2006.01)
(Continued)

(52) U.S. Cl.
CPC ..... *A47K 5/05* (2013.01); *B65D 25/10* (2013.01); *B65D 25/2838* (2013.01); *B65D 43/166* (2013.01)

(58) Field of Classification Search
CPC .... B65D 25/10; B65D 25/22; B65D 25/2838; B65D 43/166; A47K 5/05; A47K 5/02; A47K 5/04; A47K 2201/02
(Continued)

(56) References Cited

U.S. PATENT DOCUMENTS 5,806,678 A * 9/1998 Håkansson ..... A45F 5/02 224/667
5,941,376 A 8/1999 Liggett
(Continued)

FOREIGN PATENT DOCUMENTS

CN 201500055 * 6/2010
CN 201500055 U 6/2010
(Continued)

OTHER PUBLICATIONS

EPO: "European Search Report"; May 11, 2022 (ESR issued in related European Case).

*Primary Examiner* — King M Chu
(74) *Attorney, Agent, or Firm* — Bryan W. Bockhop; Bockhop Intellectual Property Law, LLC

(57) ABSTRACT

A soap container includes: a first housing member having an inner side and an outer side; and a second housing member having an inner side and an outer side; wherein the first housing member and the second housing member are releasably couplable to each other to form a housing of the soap container, and wherein the soap container is adapted to have a soap held between the inside of the first housing member and the inside of the second housing member; wherein the first housing member comprises a spacer member extending from the inside of the first housing member toward the inside of the soap container in the closed state of the soap container; and wherein the spacer member comprises a retaining member having a first magnetic property. Additionally, a coupling member has a second magnetic property, the coupling member being adapted to be mechanically coupled to the soap. The first magnetic property and the second magnetic property are adapted to magnetically attract the retaining member and the coupling member such that the coupling member is retained distant from the inside of the first
(Continued)

housing member and the inside of the second housing member.

20 Claims, 4 Drawing Sheets

(51) Int. Cl.
*B65D 25/10* (2006.01)
*B65D 25/28* (2006.01)
*B65D 43/16* (2006.01)

(58) Field of Classification Search
USPC ..... 206/438, 77.1; 248/686, 309.4
See application file for complete search history.

(56) References Cited

U.S. PATENT DOCUMENTS

| | | | | |
|---|---|---|---|---|
| 2006/0202097 | A1* | 9/2006 | Black | A47K 5/05<br>248/346.01 |
| 2008/0160249 | A1* | 7/2008 | Makino | B65D 81/113<br>428/116 |
| 2019/0142226 | A1* | 5/2019 | Teague | B65D 5/4279<br>206/77.1 |

FOREIGN PATENT DOCUMENTS

| | | | |
|---|---|---|---|
| KR | 20-2011-0001905 | | 2/2011 |
| KR | 200445804 | * | 2/2011 |

* cited by examiner

SOAP CONTAINER FOR DRYING A SOAP INSIDE A CLOSED CONTAINER

CROSS-REFERENCE TO RELATED APPLICATION(S)

This application claims the benefit of German Patent Application No. DE 20 2020 107 614.0, filed Dec. 30, 2020, the entirety of which is hereby incorporated herein by reference. This application also claims the benefit of European Patent Application No. EP21214342.4, filed Dec. 14, 2021, the entirety of which is hereby incorporated herein by reference.

BACKGROUND OF THE INVENTION

1. Field of the Invention

The present invention relates to a transportable soap container, particularly a soap container, which allows a wet bar of soap to dry when the soap container is closed.

Generally, a bar of soap rests on the bottom of the transportable container and, if not stored horizontally, the soap contacts at least one other wall due to slipping of the soap in the container. A wet soap cannot dry completely at portions, at which the soap contacts the container. Loss of soap is caused by abrasion on the walls of the soap container of a still soft or wet soap.

2. Description of the Related Art

It is known to hold the soap by means of a combination of a magnet attached to a soap holder and a magnetic element, for example a small plate, pressed into the soap. This allows the soap to dry and a larger portion of the soap can be used for washing.

DE 10 2017 119 7 21 A1 discloses a device, in which the magnetic holder is attached to a suction cup, which can be attached in a wash basin or to a shower wall.

DE 1 825 914 U1 discloses a device, in which a bar of soap is directly connected to a suspension loop arranged on an anchoring part such that it can be suspended, for example, from the fittings of a shower.

WO 2014/015368 A1 discloses a device, in which a container holding a liquid soap is connected to a suspension loop.

Therefore, there is a need for improving the drying of a bar of soap stored in a soap container and to prevent a bar of soap from becoming soft due to residual moisture and thus at least partially unusable.

SUMMARY OF THE INVENTION

The soap container according to the invention comprises a first housing element having an inner side and an outer side, and a second housing element having an inner side and an outer side. The first housing member may be a bottom member, and the second housing member may be a top member. The first housing member and the second housing member are releasably couplable to each other to form a housing of the soap container. The soap container is configured to hold a soap between an inner surface of the first housing member and an inner surface of the second housing member. According to the invention, the first housing element comprises a spacer element extending from the inner side of the first housing element in the closed state of the soap container towards the interior of the soap container.

According to the invention, the spacer element comprises a retaining element having a first magnetic property. A coupling element having a second magnetic property is mechanically couplable to a soap. The first magnetic property and the second magnetic property are adapted to magnetically attract the retaining element and the coupling element. As a result, the coupling element is held spaced apart from the inner surface of the first housing element and from the inner surface of the second housing element.

This ensures that the bar of soap is held spaced apart from the first and second housing elements so that any residual moisture present cannot cause the bar of soap to soften, liquefy, or the like. For purposes of the present invention, soap is a soap in solid form, such as a bar of soap. The coupling element may be a mandrel, a disc having a plurality of mandrels, a disc having a plurality of protrusions, a disc having a plurality of prongs, or the like, which may be pressed into the bar of soap by the user. By magnetically holding the soap, the soap can be easily removed from the soap container by the user and easily returned to the soap container after use. The soap container is particularly suitable for use while traveling.

In one embodiment, the holding element may comprise a permanent magnet, and the coupling element may comprise a ferromagnetic material.

In one embodiment, the spacer element may have a suction cup on its side facing the inside of the first housing element. This allows the soap container to be easily cleaned. Further, the suction cup can be detached from the first housing element and fixed in a bathroom, for example, in a sink of a bathroom or a shower cabinet of a bathroom. Thereby, the soap bar can be held both inside the soap container and outside the soap container while traveling in such a way that the soap bar can dry after use and damage to the soap bar due to residual moisture is avoided.

The invention thus also solves the problem of providing a unit for an improved transport container for a solid detergent, for example a soap, and at the same time serving as a device for flexible attachment of the same, but by allowing the unit to be separated, locally, from the transport container. The concept presented here allows, by means of a support removably fixed inside the transport container for the solid hygienic agent, the complete and contactless residual drying inside the closed container. The second advantage is that the holder may be separated from the transport container. Usually, a transport container for soap, for example, also serves as a dish from which the soap is removed for personal hygiene, such as washing the skin or hairs. As a result, water accumulates inside the container, which has to be dried before it can be closed. By separating the holder from the transport container, the container can be stored in a dry area, while the holder can be used in a wet area, such in the shower or in or around the washbasin. Finally, the holder can be reattached to the transport container.

In one embodiment, the retaining element may be arranged on the half of the spacer element facing away from the inner side of the first housing element. Preferably, the retaining element is arranged as far as possible from the inner side of the first housing element.

In one embodiment, the inner surface of the first soap container may include a receiving region having a mean roughness Ra of from approximately 0.1 μm to approximately 0.4 μm or lower, preferably from approximately 0.001 μm to approximately 0.4 μm or lower, on which, in use, the suction cup is disposed by a user. The receiving area may have metal on its surface. The soap receptacle may be made of plastic.

In one embodiment, a sealing element may be arranged on the first housing element and/or on the second housing element, wherein the sealing element is arranged such that, in the closed state of the soap container, the first housing element is sealed with respect to the second housing element. This can prevent residual moisture from escaping from the soap container into the luggage.

The soap container according to the invention has the advantage that the soap can be safely stored in the closed soap container for transport without the soap touching the housing. At the destination, the soap can then either be removed from the opened soap container for use and lifted off the magnetic holder in the process, or the entire magnetic holder with the suction cup is temporarily removed from the soap container and arranged on a smooth surface, for example a wash basin or a shower wall. Thereby, the soap container can be stored in a dry place while the holder with suction cup and magnet is used in the wet area.

According to an advantageous embodiment, the connecting element is suitable and configured for forming a hinge-like connecting region between the first housing element and the second housing element.

The connecting element is particularly advantageously suitable and configured for forming a suspension loop. Consequently, as a further alternative, the entire soap container can be suspended, for example, from a shower fitting, whereby, when the soap container is open, the soap can be removed from or placed back against the magnetic holder at any time.

In an advantageous embodiment, the connecting element is formed as a flat band which is passed through a respective slot in the first housing element and in the second housing element. By at least one adjusting element arranged on the connecting element, both the length of a small loop forming a hinge-like connecting region between the first housing element and the second housing element as well as the length of the suspension loop can be adjusted by displacing the adjusting element.

Due to the adjustability of the connecting element or the hinge-like connecting area formed by it, the connecting element is also particularly advantageously suitable for maintaining an unfolded open position of the first housing element relative to the second housing element. In a suspended position in a shower cubicle, the opened second housing element thereby lies in an oblique covering position over the soap, thereby preventing an undesired contact with the water flowing downward and the prematurely softening and an undesired deterioration of the soap. Such open position of the soap container is advantageous for quick access to the soap, also if it lies at the edge of the sink.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
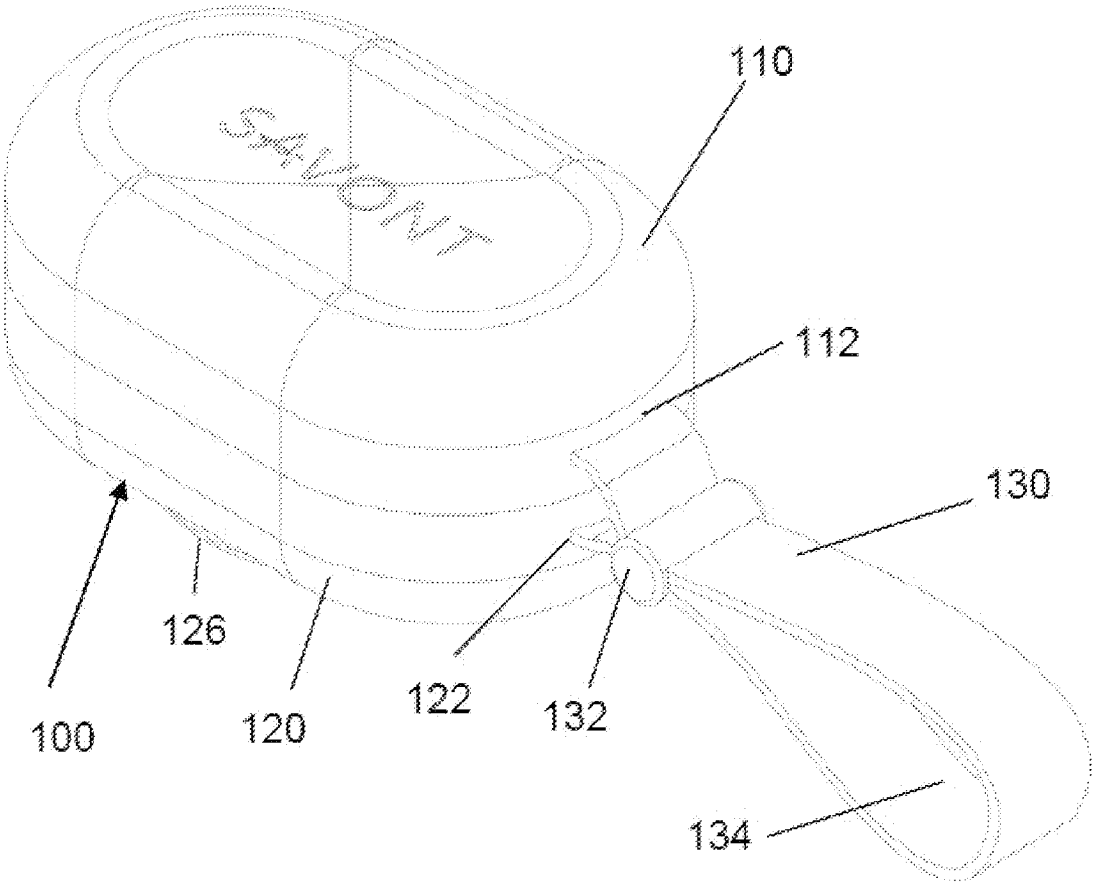
FIG. 1 shows a perspective view a closed soap container.

A preferred embodiment of the invention is now described in detail. Referring to the drawings, like numbers indicate like parts throughout the views. Unless otherwise specifically indicated in the disclosure that follows, the drawings are not necessarily drawn to scale. The present disclosure should in no way be limited to the exemplary implementations and techniques illustrated in the drawings and described below. As used in the description herein and throughout the claims, the following terms take the meanings explicitly associated herein, unless the context clearly dictates otherwise: the meaning of "a," "an," and "the" includes plural reference, the meaning of "in" includes "in" and "on."

As shown in FIG. 1, a soap container 100 includes an upper part (second housing element) 110, a lower part (first housing element) 120 and a connecting element 130 connecting these two parts.

The connecting element 130 is formed in the manner of a flat band and passes through a slot 112 in the upper part 110 and through a slot or opening 122 in the lower part 120. As can best be seen from FIGS. 2, 3, and 4, the connecting element 130 forms a small loop inside the soap container 100 that serves as a hinge-like connecting portion 136 between the upper portion 110 and the lower portion 120. Outside the soap container 100, the connecting element 130 passes through an adjustment element 132 and forms a larger suspension loop 134 on the side of the adjustment element 132 facing away from the soap container 100.

By sliding the adjustment element 132, which exerts a slight clamping action, on the connecting element 130, the size of the small loop forming the hinge-like connecting region 136 can be varied as well as the suspension loop 134. In an embodiment not shown, two independently adjustable adjustment elements 132 may also be provided.

As shown in the embodiment, the connecting element 130 may be connected to each other by positive substance jointing, such as welding as an endless band (band loop) after passing through the slots 112 and 122 and through the adjusting element 132. Instead of being formed as an endless band (band loop), an embodiment in which the two ends of the band-shaped connecting element 130 are fixedly connected to the upper part 110 and the lower part 120 of the soap container 100 is also conceivable. In this case, the ends of the connecting element 130 may be fixed, for example, by passing the ends of the connecting element 130 inwardly through the slots 112 and 122 and creating thickenings at the ends, for example by thermal deformation, which prevent subsequent withdrawal from the slots 112 and 122.

The band of the connection element 130 seals the slots 112 and 122, such that essentially no water can exit the soap container 100 but air can enter the soap container 100 for drying the soap 150.

In one embodiment the connection element 130 may be a band in which the ends are not connected to each other by positive substance jointing, such as welding. The first end of the connection element 130 may have a first looking element, such as an opening (not shown). The second end of the connection element 130 may have a second looking element complimentary to the first locking element engaging into the first locking element, such as a protrusion having from which a circular nose (not shown) extends. The circular nose may pass through the opening and engage at the first end of the connection element to form a barb.

In this embodiment the ends of the connection element 130 may be formed tapered in the longitudinal direction and/or or the thickness of the end of the connection element 130 may form a tapper. A protrusion extending perpendicular to longitudinal direction may be formed to avoid inadvertent removal of an end of the connection element through the slot 112 or 122. The protrusion may be a locally increased thickness of the band of the connection element 130. The protrusion and/or locally increased thickness may be formed at the end of the tapper, where the tapper comprises the largest thickness or broadness.

The ends of the connecting element 130 can be pushed through the adjusting element 132 before the connecting element 130 is fixed to the upper part 110 or to the lower part 120, or the adjusting element 132 can also be clipped over the two strands of the connecting element 130 subsequently.

Figure 2:
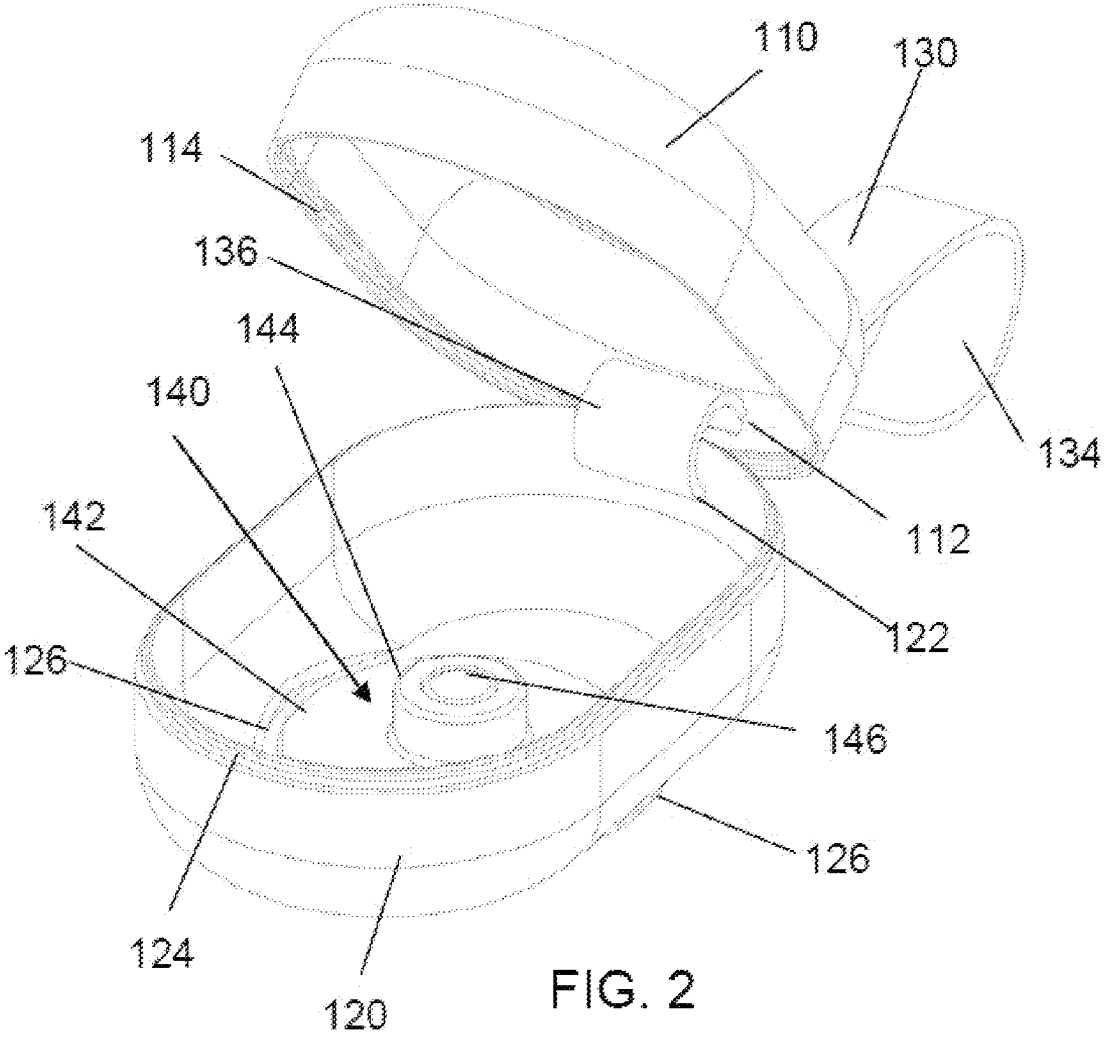
FIG. 2 shows a perspective view of the opened soap container with suction cup arrangement received therein.
Figure 3:
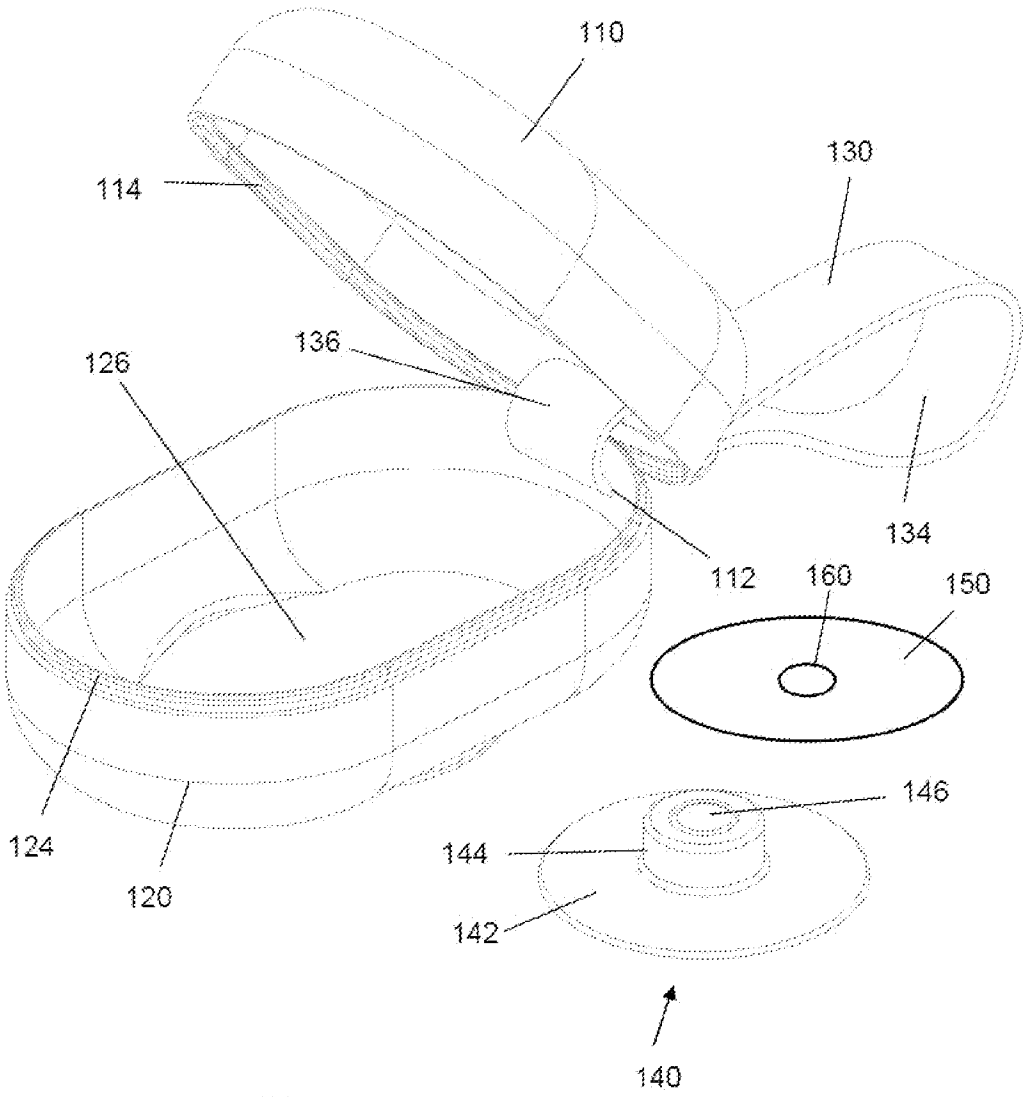
FIG. 3 shows the soap container according to FIG. 2 with the suction cup arrangement removed and a magnetic element cooperating with it on a soap.
Figure 4:
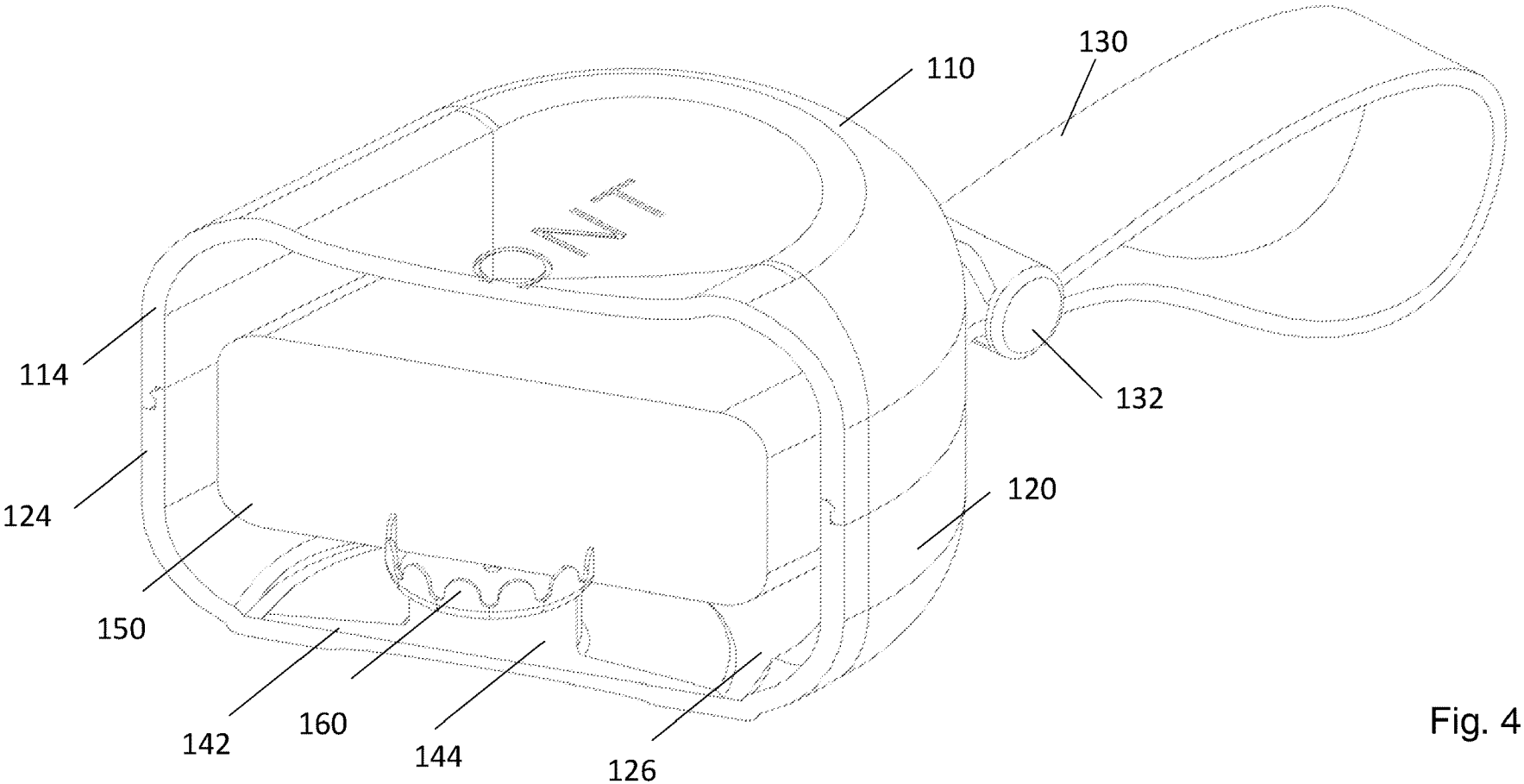
FIG. 4 shows a perspective sectional view of the soap container according to FIG. 2.

An area with a flat contact surface 126 is formed on the bottom of the lower part 120, on which a suction cup arrangement 140 is detachably attached. In FIG. 2, the suction cup arrangement 140 is secured to the contact surface 126. In FIG. 3, the suction cup arrangement 140 has been temporarily removed from the soap container 100 and can then be placed and fixed at its destination on another smooth surface, such as a wall of a sink or a shower wall.

The suction cup arrangement 140 is formed by a suction cup 142, which is flatly curved on its lower surface, and a magnet holder 144 connected thereto on its upper surface. The magnet holder 144 is used to receive and fix a permanent magnet 146, which is connected to the magnet holder 144 in a force-fit manner by press-fitting or in a substance-fit manner by adhesive bonding. Alternatively, the permanent magnet 146 can be connected to the magnet holder 144 by press-fitting or joining or by adhesive bonding with or without heat application. For high holding power, even with heavier bars of soap, the use of a neodymium magnet as the permanent magnet 146 is particularly advantageous.

In FIG. 3, a soap 150 is indicated into which a magnetic element 160, for example a ferromagnetic platelet with a serrated edge bent backwards, is pressed. The magnetic element 160 serves with its front smooth holding surface to fix the soap 150 on the permanent magnet 146.

For leak-proof transport of the soap 150 in the soap container 100, it is advantageous if the upper part 110 is provided with a sealing surface 114 and the lower part 120 is provided with a sealing surface 124, wherein the sealing surfaces 114, 124 engage each other in an at least partially sealing manner when the soap container 100 is closed.

The soap container 100 preferably has an ergonomically favorable oval shape. However, rectangular shapes with rounded corners are also possible for the soap container 100.

Instead of a soap 150, the soap container 100 according to the invention can also accommodate other solid cosmetic substances, such as a hair soap or a body cream block melting on the surface under the influence of body heat.

The invention also solves the problem of providing a unit for an improved transport container for a solid cleansing substance, for example a soap, which at the same time can serve as a device for flexible attachment thereof, but by allowing the unit to be separated, locally separate from the transport container.

THE FOLLOWING IS A LIST OF REFERENCE NUMBERS

100 soap container
110 second housing element
122 slot
114 sealing surface
120 first housing element
112 slot
124 sealing surface
126 contact surface
130 connecting element
132 adjustment element
134 suspension loop
136 (hinge-like) connecting area
140 suction cup arrangement
142 suction cup
144 magnet holder
146 permanent magnet
150 soap
160 magnetic element (at 150)

Although specific advantages have been enumerated above, various embodiments may include some, none, or all of the enumerated advantages. Other technical advantages may become readily apparent to one of ordinary skill in the art after review of the following figures and description. It is understood that, although exemplary embodiments are illustrated in the figures and described below, the principles of the present disclosure may be implemented using any number of techniques, whether currently known or not. Modifications, additions, or omissions may be made to the systems, apparatuses, and methods described herein without departing from the scope of the invention. The components of the systems and apparatuses may be integrated or separated. The operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set. It is intended that the claims and claim elements recited below do not invoke 35 U.S.C. § 112(f) unless the words "means for" or "step for" are explicitly used in the particular claim. The above-described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. A soap container, comprising:

a first housing member having an inner side and an outer side; and a second housing member having an inner side and an outer side;

wherein the first housing member and the second housing member are releasably couplable to each other to form a housing of the soap container, and wherein the soap container is adapted to have a soap held between the inside of the first housing member and the inside of the second housing member;

wherein the first housing member comprises a spacer member extending from the inside of the first housing member toward the inside of the soap container in the closed state of the soap container; and wherein the spacer member comprises a retaining member having a first magnetic property;

further comprising a coupling member having a second magnetic property, the coupling member being adapted to be mechanically coupled to the soap;

wherein the first magnetic property and the second magnetic property are adapted to magnetically attract the retaining member and the coupling member such that the coupling member is retained distant from the inside of the first housing member and the inside of the second housing member, wherein the retaining element is arranged in and/or on the half of the spacer element facing away from the inner side of the first housing element.

2. The soap container of claim 1, wherein the retaining member comprises a permanent magnet and the coupling member comprises a ferromagnetic material.

3. The soap container according to claim 1, wherein the spacer element comprises a suction cup on its side facing the inner side of the first housing element.

4. The soap container according to claim 1, wherein the inner side of the first soap container has a receiving area having a mean roughness Ra of from approximately 0.1 μm to approximately 0.4 μm on which, in use, a suction cup is arranged.

5. The soap container according to claim 4, wherein the receiving area comprises metal on its surface.

6. The soap container according to claim 1, wherein a sealing element is arranged on the first housing element and/or the second housing element, wherein the sealing element is arranged to seal the first housing element with respect to the second housing element in the closed state of the soap container.

7. The soap container according to claim 1, comprising a connecting element forming a hinge-like connecting portion between the first housing element and the second housing element.

8. The soap container according to claim 7, wherein the connecting element is formed as a suspension loop.

9. The soap container according to claim 1, wherein the inner side of the first soap container has a receiving area having a mean roughness Ra of from approximately from approximately 0.001 μm to approximately 0.4 μm on which, in use, a suction cup is arranged.

10. A soap container, comprising:

a first housing member having an inner side and an outer side; and a second housing member having an inner side and an outer side;

wherein the first housing member and the second housing member are releasably couplable to each other to form a housing of the soap container, and wherein the soap container is adapted to have a soap held between the inside of the first housing member and the inside of the second housing member;

a connecting element forming a hinge-like connecting portion between the first housing element and the second housing element wherein the connecting element is formed as a flat band that penetrates a slot in the second housing element and a slot in the first housing element, wherein the first housing member comprises a spacer member extending from the inside of the first housing member toward the inside of the soap container in the closed state of the soap container; and wherein the spacer member comprises a retaining member having a first magnetic property;

further comprising a coupling member having a second magnetic property, the coupling member being adapted to be mechanically coupled to the soap;

wherein the first magnetic property and the second magnetic property are adapted to magnetically attract the retaining member and the coupling member such that the coupling member is retained distant from the inside of the first housing member and the inside of the second housing member.

11. The soap container according to claim 10, wherein the connecting element comprises at least one slidable adjusting element suitable for adjusting the play of the hinge-like connecting portion between the first housing element and the second housing element and/or for adjusting the length of the suspension loop.

12. The soap container according to claim 10, wherein said connecting element is configured for maintaining an opened opening position of said second housing element with respect to said first housing element.

13. The soap container according to claim 10, wherein the connecting element is formed as a suspension loop.

14. The soap container according to claim 10, wherein the retaining element is arranged in and/or on the half of the spacer element facing away from the inner side of the first housing element.

15. The soap container of claim 10, wherein the retaining member comprises a permanent magnet and the coupling member comprises a ferromagnetic material.

16. The soap container according to claim 10, wherein the spacer element comprises a suction cup on its side facing the inner side of the first housing element.

17. The soap container according to claim 10, wherein the inner side of the first soap container has a receiving area having a mean roughness Ra of from approximately 0.1 μm to approximately 0.4 μm on which, in use, the suction cup is arranged.

18. The soap container according to claim 17, wherein the receiving area comprises metal on its surface.

19. The soap container according to claim 10, wherein the connecting element comprises at least one slidable adjusting element suitable for adjusting the play of the hinge-like connecting portion between the first housing element and the second housing element and/or for adjusting the length of the suspension loop.

20. A soap container, comprising:

a first housing member having an inner side and an outer side; and a second housing member having an inner side and an outer side;

wherein the first housing member and the second housing member are releasably couplable to each other to form a housing of the soap container, and wherein the soap container is adapted to have a soap held between the inside of the first housing member and the inside of the second housing member;

a connecting element forming a hinge-like connecting portion between the first housing element and the second housing element wherein the connecting element is formed as a flat band that penetrates a slot in the second housing element and a slot in the first housing element wherein the connecting element is formed as a suspension loop, wherein the first housing member comprises a spacer member extending from the inside of the first housing member toward the inside of the soap container in the closed state of the soap container; and wherein the spacer member comprises a retaining member having a first magnetic property;

further comprising a coupling member having a second magnetic property, the coupling member being adapted to be mechanically coupled to the soap;

wherein the first magnetic property and the second magnetic property are adapted to magnetically attract the retaining member and the coupling member such that the coupling member is retained distant from the inside of the first housing member and the inside of the second housing member.

* * * * *